United States Patent [19]

Nishikawa

[11] Patent Number: 4,623,070

[45] Date of Patent: Nov. 18, 1986

[54] CLOSURE CAP

[75] Inventor: Masaji Nishikawa, Funabashi, Japan

[73] Assignee: Shibazaki Seisakusho Ltd., Tokyo, Japan

[21] Appl. No.: 696,224

[22] Filed: Jan. 29, 1985

[51] Int. Cl.[4] ..... B65D 53/00

[52] U.S. Cl. ..... 215/329; 215/344; 215/DIG. 1

[58] Field of Search ..... 215/344, DIG. 1, 329

[56] References Cited

U.S. PATENT DOCUMENTS

| | | | |
|---|---|---|---|
| 3,038,624 | 6/1962 | Wieckmann | 215/41 |
| 3,055,526 | 9/1962 | Plunkett | 215/329 |
| 3,568,871 | 3/1971 | Livingstone | 215/40 |
| 3,784,041 | 1/1974 | Birch | 215/40 |
| 3,815,771 | 6/1974 | Marks | 215/344 |
| 3,865,263 | 2/1975 | Birch | 215/321 |
| 4,072,244 | 2/1978 | Mueller | 215/344 |
| 4,091,948 | 5/1978 | Northup | 215/222 |
| 4,125,201 | 11/1978 | Birch | 215/330 |
| 4,415,095 | 11/1983 | Schweigert et al. | 215/344 X |
| 4,442,947 | 4/1984 | Banich | 215/344 |
| 4,450,973 | 5/1984 | Toeppen | 215/329 |
| 4,462,502 | 7/1984 | Luenser et al. | 215/329 |
| 4,526,284 | 7/1985 | Herbert | 215/344 X |

FOREIGN PATENT DOCUMENTS

| | | | |
|---|---|---|---|
| 1213812 | 11/1959 | France | 215/344 |
| 1229322 | 4/1971 | United Kingdom | 215/344 |

*Primary Examiner*—Donald F. Norton

*Attorney, Agent, or Firm*—Arnold B. Silverman

[57] ABSTRACT

A closure cap adapted for fitment to a container having a threaded neck terminating in a rim which defines an open mouth. The closure may be formed of a molding of elastomeric material and includes a top wall having an annular skirt downwardly depending therefrom. The annular skirt has a closure thread formed about its inside surface which cooperates with the threaded neck of the container to achieve the fitment. The closure cap also contains a stepped projection formed generally at the inside juncture of the top wall and the annular skirt. The stepped projection has a vertical surface thereon. A flexible, hollow frusto-conical flange is formed integrally with the inner surface of the top wall and projects downwardly and outwardly therefrom. The flange is sufficiently thin and has sufficient length so as to enable it to bend around the outside radius of the rim. As the closure cap is threaded onto the container, the flange is flexed upwards by the rim to form a top seal, and the flange is also bent around the outside radius of the rim to form a side seal between the vertical surface of the stepped projection and the outside surface of the container's neck. The gas-tight top and side seals formed by this closure cap makes it particularly desirable as a cap for a carbonated beverage bottle.

16 Claims, 4 Drawing Figures

CLOSURE CAP

FIELD OF THE INVENTION

This invention relates to a closure cap adapted to fit over the open mouth of a container and to seal the contents thereof.

BACKGROUND OF THE INVENTION

Metal caps have been used widely for sealing containers, especially those used to hold carbonated beverages, because the metal caps were economical and easy to produce. A further advantage of the metal caps is that they provided high sealing performance when used together with a lining material.

In addition to closures which obtain a seal through the use of an independent liner such as is shown in U.S. Pat. No. 4,462,502, for example, it has been suggested to employ linerless closures which have integrally formed sealing elements. See generally U.S. Pat. Nos. 3,038,624; 3,568,871; 3,784,041; 3,815,771; 4,091,948; and 4,450,973.

Currently the industry is progressing towards the use of plastic caps because the consumer views the plastic caps as being more aesthetically pleasing. The major drawback with the use of plastic caps is their inability to retain a gas-tight seal after a period of time due to the material's creep characteristics. This becomes especially troublesome when the plastic caps are used to seal a carbonated beverage product.

The market has been flooded with a number of plastic caps of various designs which have attempted to properly seal the container but with only marginal success. U.S. Pat. Nos. 3,784,041 and 3,865,263, both issued to Birch, show various approaches for sealing a container with the use of an unlined plastic cap. The drawbacks with the Birch designs, wherein only a top seal is present, is that the seal tends to deteriorate over a period of time as the pressure of the carbonated beverage exerts upward pressure on the closure cap.

In spite of these prior art teachings, there remains therefore a very real and substantial need for a plastic closure which will provide an effective seal even when used with pressurized containers.

SUMMARY OF THE INVENTION

The present invention provides a new plastic closure cap which overcomes the deficiencies of the prior art.

This invention relates to a closure cap adapted for fitment to a container having a threaded neck terminating in a rim which defines an open mouth. The closure cap is preferably formed of a molding of elastomeric material, such as plastic, and contains a circular top wall. An annular skirt is downwardly depending from the top wall and has a closure thread formed about an inside surface thereof. This closure thread cooperates with the external threads formed on the container's neck to secure the closure cap to the container. The closure cap also contains a stepped projection having a vertical surface which is formed generally at the inside juncture where the top wall meets the annular skirt. A flexible, hollow generally frusto-conical flange is formed integrally with the inner surface of the top wall and projects generally downwardly and outwardly therefrom. The flange has sufficient length so as to bend around the outside radius of the rim and project downwardly between the vertical surface of the stepped projection and the outside surface of the container's neck. As the closure cap is threaded onto the container, the container rim compresses the flange against the inner surface of the top wall to form a top seal while the remaining portion of the flange is compressed between the vertical surface of the stepped projection and the neck of the container to form a gas-tight side seal.

A general object of this invention is to provide a closure cap made of an elastomeric material which can provide a gas-tight seal on a container. A more specific object of this invention is to provide a closure cap which will provide a top and side seal when threaded onto a carbonated beverage container.

Another object of the present invention is to provide an inexpensive linerless closure cap.

Another object of this invention is to provide a molded, linerless closure cap particularly useful for effectively sealing high pressure products.

It is another object of the present invention to provide such a closure which is attractive and permits easy opening and reclosing of the container.

Still another object of this invention is to provide a plstic cap for forming an effecitve gas-tight seal for highly volatile products including alcoholic beverages and other easily vaporized products.

Still further, an object of this invention is to provide a plastic closure cap for sealing glass and plastic containers, such as bottles or jars.

Other objects and advantages of the present invention will become apparent to those skilled in the art in view of the following description and the drawings.

DETAILED DESCRIPTION OF THE PREFERRED EMBODIMENTS

Figure 1:
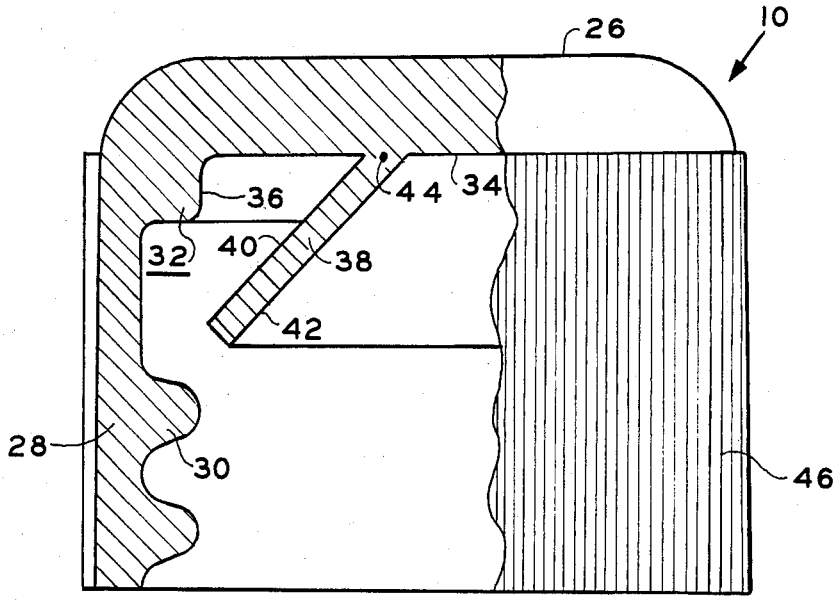
FIG. 1 is a partially broken away view of the closure cap of this invention.
Figure 2:
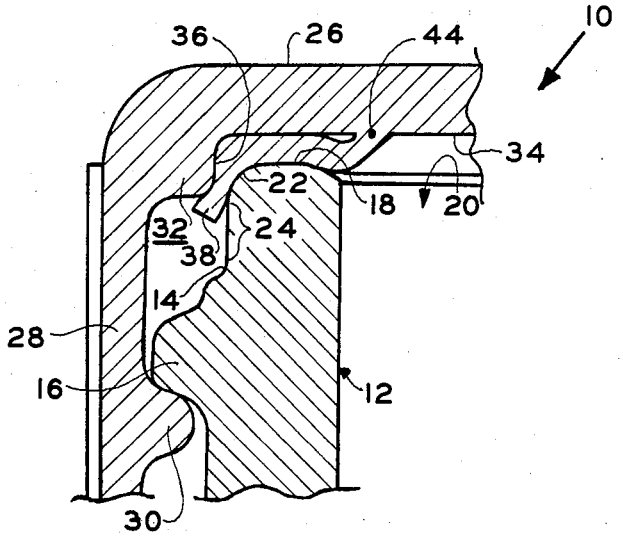
FIG. 2 is a partial cross-sectional view of the closure cap of FIG. 1 shown engaged on a container.

Referring to FIGS. 1 and 2, a closure cap 10 is shown preferably molded as a unit from an elastomeric material, such as plastic. The closure cap 10 is designed to be fitted onto a glass or plastic container 12, such as a soft drink bottle. It should be noted that the container 12 can hold various liquids including, but not limited to, a carbonated beverage, a non-carbonated liquid or an easily vaporized product. The container 12 has an annular neck 14 having an external thread 16 formed thereon. The neck 14 terminates in a rim 18 which defines an open mouth 20. The open mouth 20 provides a means to fill and empty the container. It should be noted that on most containers the rim 18 has an outside radius 22 which connects with a vertical outside surface 24 located immediately above the upper thread 16.

The closure cap 10 in the form illustrated contains a generally circular top wall 26 with a downwardly depending annular skirt 28. Formed about the inside surface of the annular skirt 28 is a spiral thread 30 which mates with the external thread 16 formed on the container's neck 14. The closure cap 10 also contains a stepped projection 32 formed generally at the inside juncture of the inner surface 34 of the top wall 26 and the annular skirt 28. The stepped projection 34 has a vertical surface 36 which is oriented generally parallel to the vertical outside surface 24 of the neck 14. Preferably, the vertical surface 36 of the stepped projection 32 extends below the outside radius 22 of the rim 18 when the closure is sealingly secured to the container.

Figure 3:
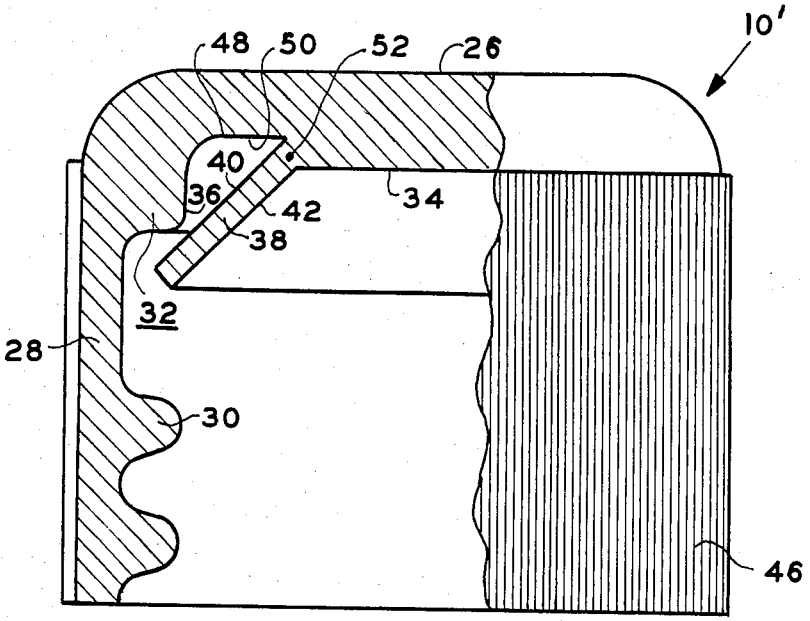
FIG. 3 is a partially broken away view of an alternative closure cap containing an annular groove formed on the inner surface of the top wall.

The closure cap 10 further contains an annular flexible, hollow generally frusto-conical flange 38 which is integrally formed with the inner surface 34 of the top wall 26. The flange 38 is preferably circumferentially continuous in order to enhance its sealing characteristics. The flange 38 is a relatively thin member preferably having an upper surface 40 which is generally parallel to a lower surface 42 and which projects angularly downwardly and outwardly towards the annular skirt 28. In the form shown the flange 38 is generally rectangular in cross-section, and is of lesser web thickness than top wall 26. The flange 38 has sufficient length to enable it to bend around the outside radius 22 of the rim 18 as the closure cap 10 is threaded onto the container 12. Preferably the flange 38 extends radially outwardly beyond vertical surface 36 as shown in FIG. 3. The flange 38 has a root 44 which is positioned above and within the circumference of the open mouth 20 of the container 12 when the closure cap 10 is securely fastened to the container 12, as shown in FIGS. 1 and 2. This enables the flange 38 to flex upwards as the closure cap 10 is threaded onto the container 12. In so doing, the rim 18 will contact the lower surface 42 of the flange 38 and press the flange upwards such that the upper surface 40 contacts the inner surface 34 of the top wall 26. This action forms a top seal between the closure cap 10 and the container 12. In addition, the free end of the flange 38 will form a side seal between the vertical surface 36 and the neck 14.

When the closure cap is threaded onto the container, the flange has a portion which is generally horizontally oriented and received in the recess defined by the inner surface of top wall 34 and the vertical surface of the stepped projection 36. Preferably the gas-tight side seal is formed as the flange 38 is compressed and elongated between the vertical surface 36 of the stepped projection 32 and the vertical surface 24 of the neck 14. The side seal is enhanced when it is effected below the outside radius 22 of the rim 18.

The novel feature of having a flexible or resilient flange 38 which is downwardly and outwardly projecting from the inner surface 34 of the top wall 26 enables a true gas-tight seal to be formed as the closure cap 10 is threaded onto the container 12. This is because two seals are formed, one on the top surface and one on the side surface of the container 12.

When a carbonated beverage is contained in a container having a plastic cap, it is common knowledge to those skilled in the closure art that the pressure within the container can cause the top wall 26 of the closure cap 10 to mushroom or bulge upwards thereby affecting the sealing characteristics of the top seal. However, when both a top seal and a side seal are present, as any bulging occurs, the stepped projection 32 is forced inwards towards the neck 14 and the side seal is squeezed tighter. This insures that in a carbonated beverage container the gas will not escape. Furthermore, by making the flange 38 integral with the inner surface 34 of the closure cap 10, one can use the physical characteristics of plastic, such as creeping, to advantage. As the annular skirt 28 of the closure cap 10 tries to deform outwardly, the flange 38 will be pulled outwards as well thereby filling any voids that may be formed by the earlier deformation.

The closure cap 10 is also shown having a plurality of vertical grooves 46 formed on its exterior surface. The grooves 46 assist in preventing the fingers of a person from slipping while he or she attempts to apply or remove the closure cap 10.

Figure 4:
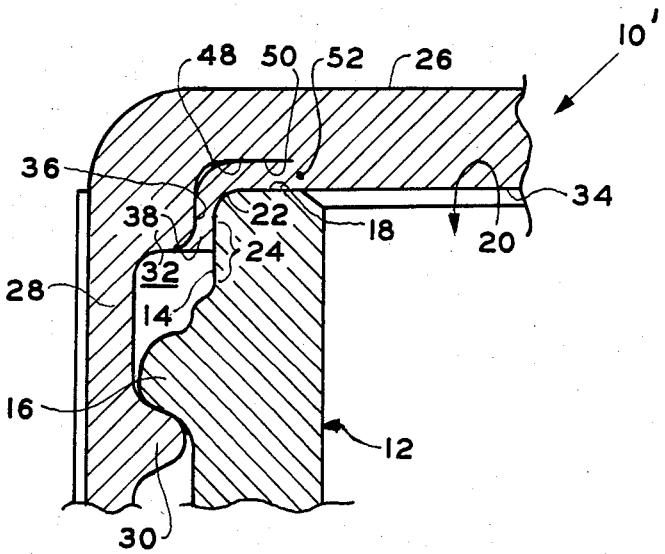
FIG. 4 is a partial cross-sectional view of the closure cap of FIG. 3 shown engaged on a container.

Referring to FIGS. 3 and 4, an alternative embodiment of a closure cap 10' is shown. For purposes of discussion, FIGS. 3 and 4 use the same numerals as those indicated in FIGS. 1 and 2 for identical elements.

The closure cap 10' is different from the closure cap 10 in that it contains an annular groove 48 formed in the inner surface 34 of the top wall 26. The groove 48 contains an upper surface 50 and may also extend in the radial direction to the vertical surface 36 of the stepped projection 32. Another way of stating this is that the inner surface 36 which in the form shown is generally vertically oriented of the stepped projection 32 is of greater height as compared with that shown in FIGS. 1 and 2. The flange 38 is also integrally formed with the inner surface 34 but preferably the flange 38 has a root 52 located above the rim 18 when the closure cap 10' is secured to the container 12. This facilitates obtaining a gas-tight top seal.

As the closure cap 10' is threaded onto the container 12, the rim 18 will abut the lower surface 42 of the flange 38 and urge the flange 38 into the groove 48. As this happens, the upper surface 40 of the flange 38 will contact the upper surface 50 of the groove 48. This is to be contrasted with the embodiment of FIGS. 1 and 2 wherein surface 40 is urged into contact with inner surface 34. Referring to FIG. 4, one can see that the lower surface 42 of the flange 38 is moved upward so that it lies in the same plane as the inner surface 34 of the top wall 26. As the free end of the flange 38 is permitted to bend or flex around the outside radius 22 of the rim 18, a side seal is also formed between the vertical surface 36 of the stepped projection 32 and the vertical surface 24 of the neck 14. It should be noted that when the groove 48 is present, the flange 38 can be pressed and squeezed into the groove 48 such that a gas-tight top seal is formed regardless of the wall thickness or contour of the container neck 14. Preferably the depth of the annular groove 48 is approximately equal to the thickness of the flange 38. However, in some instances it may be advantageous to make the depth of the grooves slightly less than the thickness of the flange 38 to take into account the fact that the flange 38 is compressed and thinned as the top seal is formed.

It will be appreciated, therefore, that the present invention provides a closure which through unique seals will permit effective use with containers having pressurized contents or contents which are readily volatilized or other contents.

While the invention has been described in conjunction with two specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A closure cap adapted for fitment to a container having a threaded neck terminating in a rim which defines an open mouth, said closure cap being formed of a molding of elastomeric material and comprising:

a top wall;

an annular skirt downwardly depending from said top wall having a closure thread formed about an inside surface thereof which cooperates with said threaded neck of said container to achieve said fitment;

a stepped projection formed generally at the inside juncture of said top wall and said annular skirt, said stepped projection containing a generally vertical surface;

sealing means for providing a gas-tight seal as said closure cap is fitted to said container, said sealing means including a flexible, annular flange projecting outwardly from an inner surface of said top wall and having sufficient length to bend around the inside radius of said rim and be compressed between the vertical surface of said stepped projection and the neck of said container to form said seal; and said flange extends radially outwardly beyond said stepped projection vertical wall, whereby when the closure cap is threaded onto the container, said flange has a portion which is generally horizontally oriented and received in a recess defined by said generally vertical surface of said stepped projection and said inner surface of said top wall.

2. The closure cap of claim 1 wherein said flange is integrally formed with the inner surface of said top wall.

3. The closure cap of claim 2 wherein said top wall is generally circular.

4. The closure cap of claim 3 wherein said flange is of hollow generally frusto-conical configuration and projects radially downwardly and outwardly from the inner surface of said top wall.

5. The closure cap of claim 4 wherein said flange has a pair of generally parallel surfaces.

6. The closure cap of claim 1 wherein said flange is compressed between the inner surface of said top wall and said container rim to form a top seal and is compressed between the vertical surface of said stepped projection and the neck of said container, below the outside radius of said rim, to form a side seal.

7. The closure cap of claim 6 wherein said flange is circumferentially generally continuous.

8. A closure cap adapted for fitment to a container having a threaded neck terminating in a rim which defines an open mouth, said closure cap being formed of a molding of elastomeric material and comprising:

a top wall;

an annular skirt downwardly depending from said top wall having a closure thread formed about an inside surface thereof which cooperates with said threaded neck of said container to achieve said fitment;

a stepped projection formed generally at the inside juncture of said top wall and said annular skirt, said stepped projection containing a generally vertical surface;

sealing means for providing a gas-tight seal as said closure cap is fitted to said container, said sealing means including a flexible, annular flange projecting outwardly from an inner surface of said top wall and having sufficient length to bend around the inside radius of said rim and be compressed between the vertical surface of said stepped projection and the neck of said container to form said seal; and said flange has a root formed within the inner surface of said top wall which root is positioned generally above and within the circumference of said open mouth of said container when said closure cap is fitted to said container, whereby when the closure cap is threaded onto the container, said flange has a portion which is generally horizontally oriented and received in a recess defined by said generally vertical surface of said stepped projection and said inner surface of said top wall.

9. A closure cap adapted for fitment to a container having an externally threaded neck terminating in a rim which defines an open mouth, said closure cap being formed of a molding of elastic material and comprising:

a top wall;

an annular skirt downwardly depending from said top wall having a closure thread formed about an inside surface thereof which cooperates with said threaded neck of said container to achieve said fitment;

a stepped projection formed generally at the inside juncture of said top wall and said annular skirt, said stepped projection containing a generally vertical surface;

an annular groove formed in the inner surface of said top wall adjacent to the vertical surface of said stepped projection;

said groove has a depth approximately equal to the thickness of said flange;

a flexible annular flange formed integrally with the inner surface of said top wall and projecting downwardly and outwardly therefrom, said flange being pressed upwardly into said groove as said closure cap is threaded onto said container such that a lower surface of said flange lies generally in the same plane as the inner surface of said top wall to form a gas-tight top seal with said rim and said flange having sufficient length to bend around the outside radius of said rim and be compressed between the vertical surface of said stepped projection and the neck of said container to form a gas-tight side seal; and said flange extends radially outward beyond said stepped projection vertical wall.

10. The closure cap of claim 9 wherein said annular flange is a hollow generally frusto-conical configuration.

11. The closure cap of claim 9 wherein said side seal is formed below the outside radius of said rim.

12. The closure cap of claim 11 wherein said flange has a root formed with the inner surface of said top wall which root is positioned generally above said rim when said closure is fitted to said container.

13. The closure cap of claim 12 wherein said flange is circumferentially generally continuous.

14. The closure cap of claim 9 wherein said annular groove has a depth slightly less than the thickness of said flange.

15. The closure cap of claim 9 wherein said annular groove has a depth substantially equal to the thickness of said flange.

16. A closure cap adapted for fitment to a container having an externally threaded neck terminating in a rim which defines an open mouth, said closure cap being formed of a molding of elastic material and comprising:

a circular top wall;

an annular skirt downwardly depending from said top wall having a closure thread formed about an inside surface thereof which cooperates with said threaded neck of said container to achieve said fitment;

a stepped projection formed generally at the inside juncture of said top wall and said annular skirt, said stepped projection containing a generally vertical surface;

a groove formed annularly about the inner surface of said top wall and extending to the vertical surface of said stepped projection;

said groove has a depth approximately equal to the thickness of said flange;

a flexible hollow generally frusto-conical flange formed integrally with the inner surface of said top wall and projecting downwardly and outwardly therefrom, said flange being pressed upwardly into said groove as said closure cap is threaded onto said container such that a lower surface of said flange lies generally in the same plane as the inner surface of said top wall to form a gas-tight top seal with said rim and said flange having sufficient length to bend around the outside radius of said rim and be compressed between the vertical surface of said stepped projection and the neck of said container to form a gas-tight side seal, and said flange extends radially outward beyond said stepped projection vertical wall.

* * * * *